US010046434B2

(12) United States Patent
Natsume et al.

(10) Patent No.: US 10,046,434 B2
(45) Date of Patent: Aug. 14, 2018

(54) EYEGLASS LENS PERIPHERY PROCESSING APPARATUS

(75) Inventors: Katsuhiro Natsume, Toyohashi (JP); Kyoji Takeichi, Gamagori (JP)

(73) Assignee: NIDEK CO., LTD., Aichi (JP)

( * ) Notice: Subject to any disclaimer, the term of this patent is extended or adjusted under 35 U.S.C. 154(b) by 955 days.

(21) Appl. No.: 13/435,609

(22) Filed: Mar. 30, 2012

(65) Prior Publication Data

US 2012/0252315 A1 Oct. 4, 2012

(30) Foreign Application Priority Data

Mar. 30, 2011 (JP) ..... 2011-076896

(51) Int. Cl.
*B24B 49/10* (2006.01)
*B24B 9/14* (2006.01)
*B24B 51/00* (2006.01)

(52) U.S. Cl.
CPC ..... *B24B 49/10* (2013.01); *B24B 9/14* (2013.01); *B24B 9/148* (2013.01); *B24B 51/00* (2013.01)

(58) Field of Classification Search
CPC ..... B24B 9/14; B24B 51/00; B24B 49/10; B24B 9/148
USPC ..... 451/5, 41, 42, 43
See application file for complete search history.

(56) References Cited

U.S. PATENT DOCUMENTS 5,485,399 A * 1/1996 Saigo et al. ..... 351/178
5,716,256 A * 2/1998 Mizuno et al. ..... 451/5
5,803,793 A * 9/1998 Mizuno et al. ..... 451/5
6,099,383 A * 8/2000 Mizuno et al. ..... 451/5
6,328,635 B1 * 12/2001 Suzuki et al. ..... 451/43
6,409,574 B1 6/2002 Shibata
6,688,944 B2 * 2/2004 Hatano et al. ..... 451/5
7,151,854 B2 * 12/2006 Shen et al. ..... 382/203
8,671,532 B2 * 3/2014 Shibata et al. ..... 29/26 A
2002/0022436 A1 2/2002 Mizuno et al.
(Continued)

FOREIGN PATENT DOCUMENTS

EP 0235021 A2 9/1987
EP 1155775 A2 11/2001
(Continued)

OTHER PUBLICATIONS

Communication dated Jul. 23, 2012 by the European Patent Office in counterpart European Application No. 12002265.2.
(Continued)

*Primary Examiner* — Christopher M Koehler
*Assistant Examiner* — Joel Crandall
(74) *Attorney, Agent, or Firm* — Sughrue Mion, PLLC

(57) ABSTRACT

An eyeglass lens periphery processing apparatus for processing an eyeglass lens includes: a lens shuck shaft holding the eyeglass lens; a data input unit inputting target lens shape data and layout data of an optical center of the lens with respect to the target lens shape; left and right lens selecting unit inputting a selection signal as to whether the lens held by the lens chuck shaft is a right lens or a left lens; a lens shape detecting unit detecting the lens shape; a confirming unit confirming whether the lens held by the lens chuck shaft is the correct one of the right lens and the left lens based on the detecting result of the lens shape detecting unit, the layout data and the selection signal; and a notifying unit notifying the confirming result of the confirming unit.

13 Claims, 6 Drawing Sheets

(56) References Cited

U.S. PATENT DOCUMENTS

| | | | | |
|---|---|---|---|---|
| 2002/0045403 | A1* | 4/2002 | Hatano et al. | 451/5 |
| 2002/0072299 | A1* | 6/2002 | Obayashi | 451/5 |
| 2008/0132147 | A1* | 6/2008 | Takeichi | B24B 9/14<br>451/5 |
| 2008/0204654 | A1* | 8/2008 | Kigawa | B24B 9/146<br>351/178 |
| 2009/0176442 | A1 | 7/2009 | Takeichi et al. | |
| 2010/0312573 | A1* | 12/2010 | Haddadi | 705/1.1 |

FOREIGN PATENT DOCUMENTS

| | | | |
|---|---|---|---|
| EP | 1366857 | A1 | 12/2003 |
| EP | 1916059 | A2 | 4/2008 |
| EP | 2067572 | A2 | 6/2009 |
| JP | 3-149170 | A | 6/1991 |
| JP | 2000-254847 | A | 9/2000 |
| JP | 2001-47348 | A | 2/2001 |
| JP | 2008-105151 | A | 5/2008 |
| JP | 2008-137106 | A | 6/2008 |

OTHER PUBLICATIONS

Communication, Issued by the Japan Patent Office, dated Jan. 6, 2015, in counterpart Japanese Application No. 2011-076896.

* cited by examiner

EYEGLASS LENS PERIPHERY PROCESSING APPARATUS

BACKGROUND

The present invention relates to an eyeglass lens periphery processing apparatus that processes a periphery of an eyeglass lens.

The eyeglass lens periphery processing apparatus holds an eyeglass lens by a lens chuck shaft, and processes the periphery of the lens by a periphery processing tool such as a grindstone while rotating the lens based on a target lens shape. The target lens shapes are different between the left side (left lens) and the right side (right lens), and optical center positions of the lens relative to the target lens shape are different between the left lens and the right lens. For this reason, a worker needs to hold the lens in the chuck shaft without confusing the left side and the right side of the lens at the time of setting (a selection) of the left side and the right side of lens processing conditions that are input to the apparatus. When the periphery processing of the lens is executed in the state that the left side and the right side of the lens are wrongly recognized, the lens cannot be used. As a technique of reducing the selection mistake between the left side and the right side of the lens, techniques disclosed in JP-A-2008-105151 and JP-A-2008-137106 are known.

SUMMARY

If the techniques of JP-A-2008-105151 and JP-A-2008-137106 are used, a problem of the selection mistake between the left side and the right side of the lens is reduced, but a further improvement is desired.

Furthermore, the selection mistake between the left side and the right side of the lens is generated in the case of performing the periphery processing of blank lenses based on the target lens shape, and in addition, the selection mistake is easily generated in the case of a so-called "retouching" which performs a size adjustment processing for reducing the size of the processed lens.

An object of the present invention is to provide an eyeglass lens periphery processing apparatus that is able to reduce the selection mistake between the left side and the right side of the lens when performing the periphery processing of the lens.

An aspect of the present invention provides the following arrangements:

(1) An eyeglass lens periphery processing apparatus for processing a periphery of an eyeglass lens by a periphery processing tool, the apparatus comprising:
- a lens shuck shaft configured to hold the eyeglass lens;
- a data input unit configured to input target lens shape data and layout data of an optical center of the lens with respect to the target lens shape;
- left and right lens selecting unit configured to input a selection signal as to whether the lens held by the lens chuck shaft is a right lens or a left lens;
- a lens refractive surface shape detecting unit which includes a tracing stylus configured to contact a front refractive surface and a rear refractive surface of the lens held by the lens chuck shaft, and a detector configured to detect movement of the tracing stylus, the lens refractive surface shape detecting unit obtaining a shape of the refractive surface of the lens based on the detecting result of the detector;
- a confirming unit configured to confirm whether the lens held by the lens chuck shaft is the correct one of the right lens and the left lens based on the detecting result of the lens refractive surface shape detecting unit, the input layout data and the input selection signal; and
- a notifying unit configured to notify the confirming result of the confirming unit.

(2) The eyeglass lens periphery processing apparatus according to (1), wherein
- the confirming unit obtains a first optical center position of the lens held by the lens chuck shaft based on the detecting result of the lens refractive surface shape detecting unit, and obtains a second optical lens position of the lens based on the input layout data and the input selection signal, compare the first optical center position with the second optical center position, and confirm whether the lens held by the lens chuck shaft is the correct one of the right lens and the left lens based on the comparison result.

(3) The eyeglass lens periphery processing apparatus according to (2), wherein the confirming unit obtains a center position of the front refractive surface and a center position of the rear refractive surface based on the shape of the front refractive surface and the shape of the rear refractive surface which are detected by the lens refractive surface shape detecting unit, and obtains the first optical center position based on the obtained center position of the front refractive surface and the obtained center position of the rear refractive surface.

(4) The eyeglass lens periphery processing apparatus according to (1) further comprising:
- a retouching mode setting unit configured to set a retouching mode for adjusting a size of the processed lens; and
- a memory for storing a right target lens shape and a left target lens shape,
- wherein when the retouching mode setting unit sets the retouching mode, the confirming unit obtains the different points between the right target lens shape and the left target lens shape, and causes the lens refractive surface shape detecting unit to detect a part of the refractive surface of the surface held by the lens chuck shaft based on the obtained different points, and confirms whether the lens held by the lens chuck shaft is the correct one of the right lens and the left lens based on the detecting result of the lens refractive surface shape detecting unit.

(5) The eyeglass lens periphery processing apparatus according to (1) further comprising:
- a retouching mode setting unit configured to set a retouching mode for adjusting a size of the processed lens; and
- a memory for storing an edge thickness of the left lens and an edge thickness of the right lens detected by the lens refractive surface shape detecting unit based on the target lens shape before retouching,
- wherein when the retouching mode setting unit sets the retouching mode, the confirming unit obtains different points of the edge thicknesses stored in the memory between the left lens and the right lens, causes the lens refractive surface shape detecting unit to detect a first edge thickness of the lens held by the lens chuck shaft, and confirms whether the lens held by the lens chuck shaft is the correct one of the right lens and the left lens based on the detected first edge thickness and a second edge thickness which is the edge thickness of the left lens or the right lens read out from the memory based on the selection signal.

(6) An eyeglass lens periphery processing apparatus for processing a periphery of an eyeglass lens by a periphery processing tool, the apparatus comprising:

a lens shuck shaft configured to hold the eyeglass lens;

a data input unit configured to input target lens shape data and layout data of an optical center of the lens with respect to the target lens shape;

left and right lens selecting unit configured to input a selection signal as to whether the lens held by the lens chuck shaft is a right lens or a left lens;

a lens outer diameter detecting unit which includes a tracing stylus configured to contact the periphery of the lens held by the lens chuck shaft and a detector configured to detect movement of the tracing stylus, the lens outer diameter detecting unit detecting an outer diameter shape of the lens based on the detecting result of the detector;

a confirming unit configured to confirm whether the lens held by the lens chuck shaft is the correct one of the right lens and the left lens based on the detecting result of the lens outer diameter detecting unit, the input layout data and the input selection signal; and a notifying unit configured to notify the confirming result of the confirming unit.

(7) The eyeglass lens periphery processing apparatus according to (6), wherein the confirming unit obtains a first optical center position of the lens held by the lens chuck shaft based on the detecting result of the lens outer diameter detecting unit, and obtains a second optical lens position of the lens based on the input layout data and the input selection signal, compare the first optical center position with the second optical center position, and confirm whether the lens held by the lens chuck shaft is the correct one of the right lens and the left lens based on the comparison result.

(8) The eyeglass lens periphery processing apparatus according to (7), wherein the confirming unit obtains a geometry center of the outer diameter shape of the lens based on the detecting result of the lens outer diameter detecting unit, and obtains the first optical center position based on the obtained geometry center.

(9) The eyeglass lens periphery processing apparatus according to (1) further comprising a retouching mode setting unit configured to set a retouching mode for adjusting a size of the processed lens, wherein when the retouching mode setting unit sets the retouching mode, the confirming unit compares the lens outer diameter shape detected by the lens outer diameter detecting unit with a left or right target lens shape which is determined by the selection unit, and confirms whether the lens held by the lens chuck shaft is the correct one of the right lens and the left lens based on the comparison result.

DESCRIPTION OF EXEMPLARY EMBODIMENTS

Figure 1:
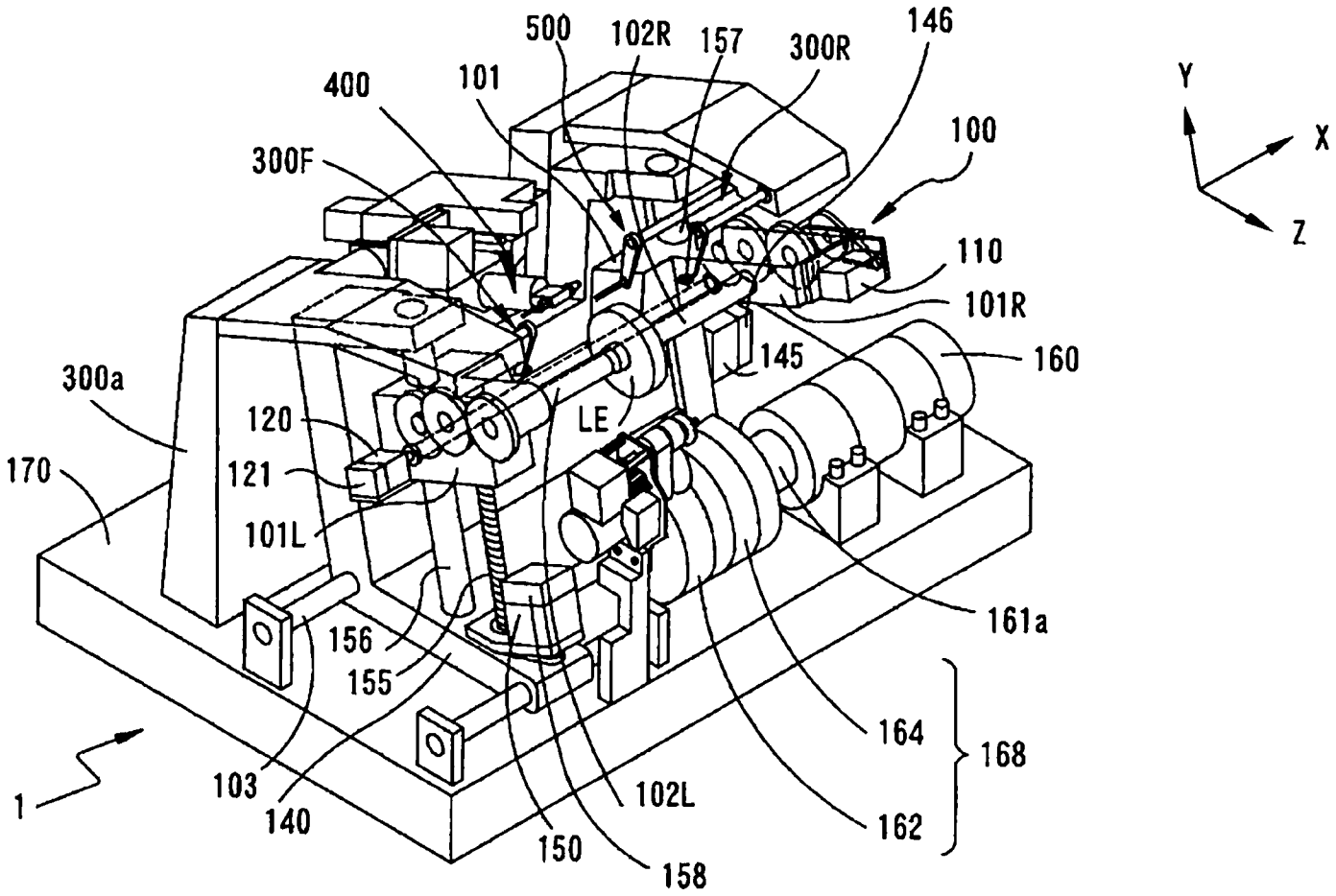
FIG. 1 is a schematic configuration diagram of an eyeglass lens periphery processing apparatus.

An embodiment of the present invention will be described based on the drawings. FIG. 1 is a schematic configuration diagram of an eyeglass lens periphery processing apparatus.

a carriage 101 which rotatably holds a pair of lens chuck shafts 102L and 102R is mounted on a base 170 of the processing apparatus 1. A periphery of an eyeglass lens LE held between the chuck shafts 102L and 102R is processed while being pressed against the respective grindstones of a grindstone group 168 as a processing tool which is concentrically attached to a spindle (a processing tool rotation shaft) 161*a*. The grindstone group 168 includes a coarse grindstone 162, and a finishing grindstone 164 with a V groove and a flat processing surface for forming a bevel. A processing tool rotation unit is constituted by the components. A cutter may be used as the processing tool.

The lens chuck shaft 102R is moved to the lens chuck shaft 102L side by a motor 110 attached to a right arm 101R of the carriage 101. Furthermore, the lens chuck shafts 102R and 102L are synchronously rotated by a motor 120 attached to a left arm 101L via a rotation transmission mechanism such as a gear. An encoder 121, which detects rotation angles of the lens chuck shafts 102R and 102L, is attached to the rotation shaft of the motor 120. In addition, it is possible to detect the load torque applied to the lens chuck shafts 102R and 102L during processing by the encoder 121. The lens rotation unit is constituted by the components.

The carriage 101 is mounted on a support base 140 which is movable along shafts 103 and 104 extended in an X axis direction (an axial direction of the chuck shaft), and is moved in the X axis direction by the driving of a motor 145. An encoder 146, which detects a movement position of the carriage 101 (the chuck shafts 102R and 102L) in the X axis direction, is attached to the rotation shaft of the motor 145. An X axis moving unit is constituted by these components. Furthermore, shafts 156 and 157 extended in a Y axis direction (a direction in which an inter-axis distance between the chuck shafts 102L and 102R and a grindstone spindle 161*a* fluctuates) is fixed to the support based 140. The carriage 101 is mounted on the support base 140 so as to be movable along the shafts 156 and 157 in the Y axis direction. A Y axis moving motor 150 is fixed to the support base 140. The rotation of the motor 150 is transmitted to a ball screw 155 extended in the Y axis direction, and the carriage 101 is moved in the Y axis direction by the rotation of the ball screw 155. An encoder 158, which detects the movement position of the lens chuck shaft in the Y axis direction, is attached to the rotation shaft of the motor 150. A Y axis moving unit (an inter-axis distance variation unit) is constituted by these components.

Figure 2:
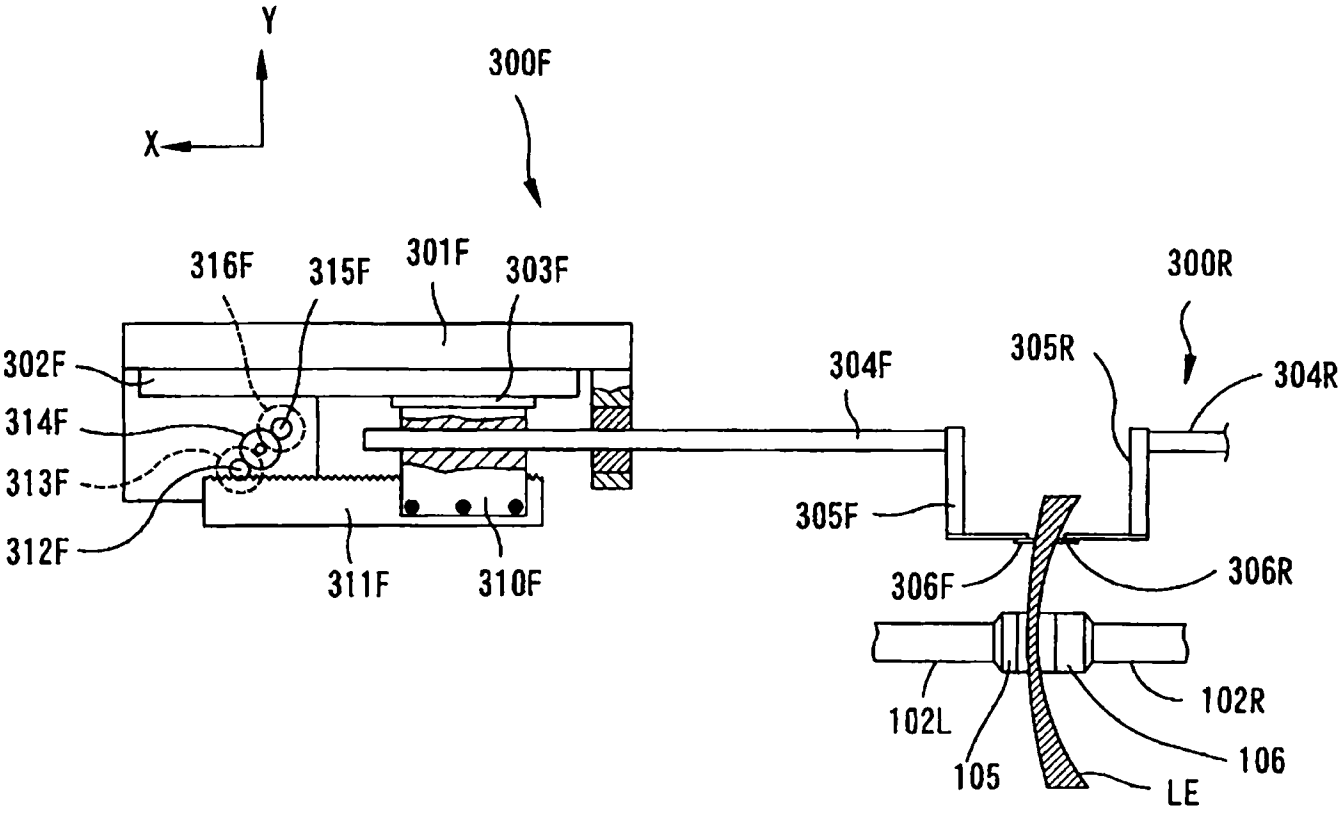
FIG. 2 is a schematic configuration diagram of a lens edge position detection unit.

In FIG. 1, in the left and right sides of the upper part of the carriage 101, lens edge position detection units 300F and 300R as a first lens shape detection unit (a lens refractive surface shape detection unit) are provided. FIG. 2 is a schematic configuration diagram of the detection unit 300F which detects an edge position (an edge position of the lens front refractive surface side on the target lens shape) of the lens front refractive surface.

A support base 301F is fixed to a block 300*a* fixed on the base 170. On the support base 301F, a tracing stylus arm 304F is held so as to slidable in the X axis direction via the slide base 310F. An L type hand 305F is fixed to the tip portion of the tracing stylus arm 304F, and a tracing stylus 306F is fixed to the tip of the hand 305F. The tracing stylus 306F comes into contact with the front refractive surface of the lens LE. A rack 311F is fixed to a lower end portion of the slide base 310F. The rack 311F is meshed with a pinion 312F of an encoder 313F fixed to the support base 310F side. Furthermore, the rotation of the motor 316F is transmitted to the rack 311F via a rotation transmission mechanism such as gears 315F and 314F, and the slide base 310F is moved in the X axis direction. The tracing stylus 306F situated in a retracted position is moved to the lens LE side by the movement of the motor 316F, and measurement force is applied which presses the tracing stylus 306F against the lens LE. When detecting the front refractive surface position of the lens LE, the lens chuck shafts 102L and 102R are moved in the Y axis direction while the lens LE is rotated based on the target lens shape, and the edge position (the lens front refractive surface edge of the target lens shape) of the lens front refractive surface in the X axis direction is detected over the whole periphery of the lens by the encoder 313F. The edge position detection is preferably performed by a measurement trace of the outside (for example, 1 mm outside) of the target lens shape by a predetermined amount, in addition to the measurement trace of the target lens shape. With the edge position detection through two measurement traces, a slope of the lens refractive surface in the edge position of the target lens shape is obtained.

A configuration of the edge position detection unit 300R of the lens rear refractive surface is bilateral symmetry of the detection unit 300F, and thus, "F" of ends of the reference numerals attached to the respective components of the detection unit 300F shown in FIG. 2 is replaced with "R", and the descriptions thereof will be omitted.

Figure 3:
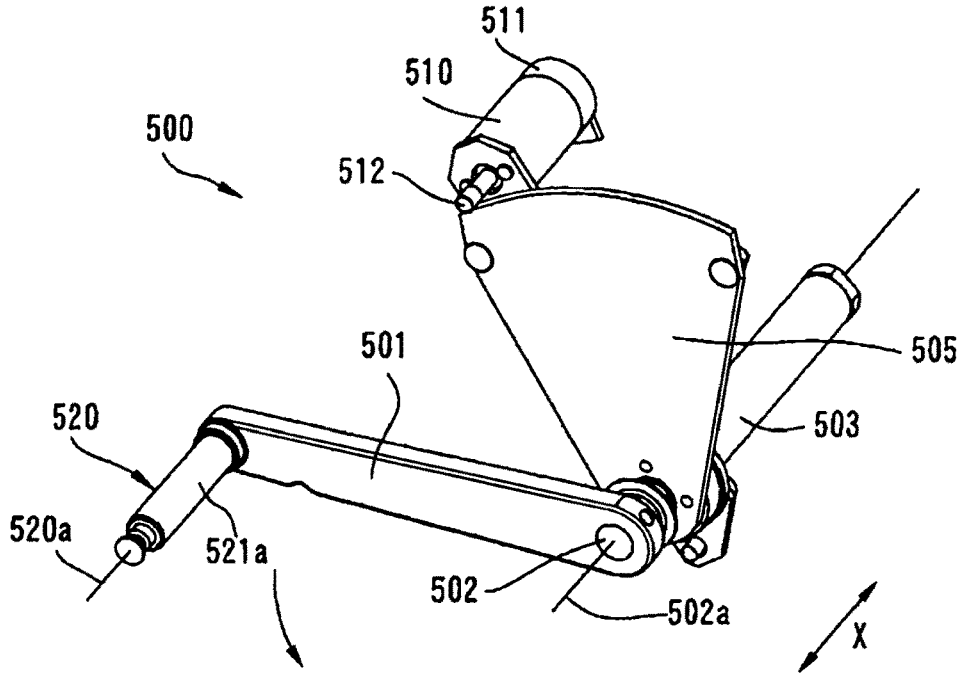
FIG. 3 is a schematic configuration diagram of a lens outer diameter detection unit.

In FIG. 1, a lens outer diameter detection unit 500 as a second lens shape detection unit is placed behind the upside of the lens chuck shaft 102R. FIG. 3 is a schematic configuration diagram of the lens outer diameter detection unit 500.

A cylindrical tracing stylus 520 coming into contact with the edge (the periphery) of the lens LE is fixed to an end of the arm 501, and a rotation shaft 502 is fixed to the other end of the arm 501. A cylindrical portion 521*a* comes into contact with the periphery of the lens LE. A center axis 520*a* of the tracing stylus 520 and a center axis 502*a* of the rotation shaft 502 are placed in a position relationship parallel to the lens chuck shafts 102L and 102R (the X axis direction). The rotation shaft 502 is held in the holding portion 503 so as to be rotatable around the center axis 502*a*. The holding portion 503 is fixed to the block 300*a* of FIG. 1. The rotation shaft 502 is rotated by the motor 510 via the gear 505 and the pinion gear 512. As the detector, an encoder 511 is attached to the rotation shaft of the motor 510. The rotation amount of the tracing stylus 520 around the center axis 502*a* is detected by the encoder 511, and the outer diameter of the lens LE is detected from the detected rotation amount.

Figure 4:
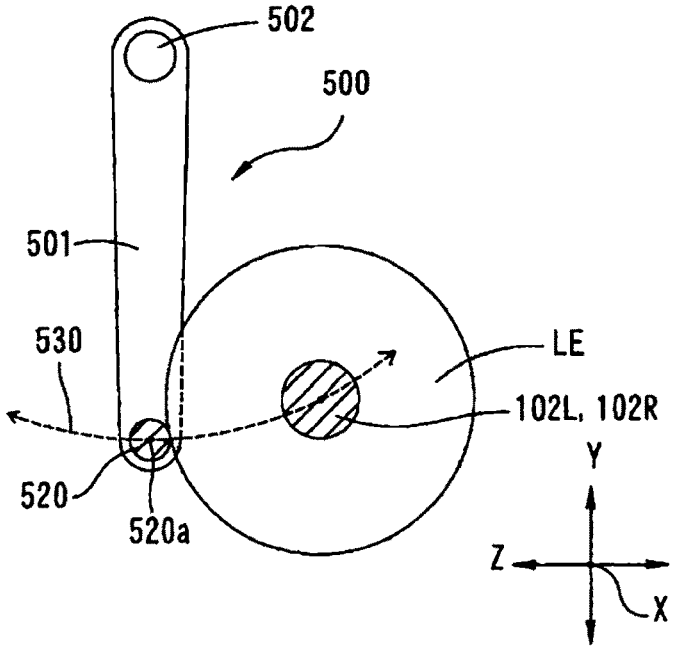
FIG. 4 is an explanatory diagram of the lens outer diameter detection by the lens outer diameter detection unit.

As shown in FIG. 4, when measuring the outer diameter of the lens LE, the lens chuck shafts 102L and 102R are moved to a predetermined measurement position (on a movement trace 530 of the center axis 520*a* of the tracing stylus 520 rotated around the rotation shaft 502). The arm 501 is rotated to a direction (the Z axis direction) perpendicular to the X axis and the Y axis of the processing apparatus 1 by the motor 510, whereby the tracing stylus 520 placed in the retracted position is moved to the lens LE side, and the cylindrical portion 521*a* of the tracing stylus 520 comes into contact with the edge (the outer periphery) of the lens LE. Furthermore, a predetermined measurement force is applied to the tracing stylus 520 by the motor 510. The lens LE is rotated for each predetermined minute angle step, and the movement of the tracing stylus 520 of this time is detected by the encoder 511, whereby the outer diameter size of the lens LE based on the chuck center (the processing center, and the rotation center) is measured.

The lens outer diameter detection unit 500 is constituted by a rotation mechanism of the arm 501 as mentioned above, and in addition, the lens outer diameter detection unit 500 may be a mechanism which is linearly moved in a direction perpendicular to the X axis and the Y axis of the processing apparatus 1. Furthermore, the lens edge position detection unit 300F (or 300R) can also be used as the lens outer diameter detection unit. In this case, the lens chuck shafts 102L and 102R are moved in the Y axis direction so as to move the tracing stylus 306F to the lens outer diameter side in the state of bringing the tracing stylus 306F into contact with the lens front refractive surface. When the tracing stylus 306F is detached from the refractive surface of the lens LE, the detection value of the encoder 313F is rapidly changed, and thus, it is possible to detect the outer diameter of the lens LE from the movement distance of the Y axis direction of this time.

Figure 5:
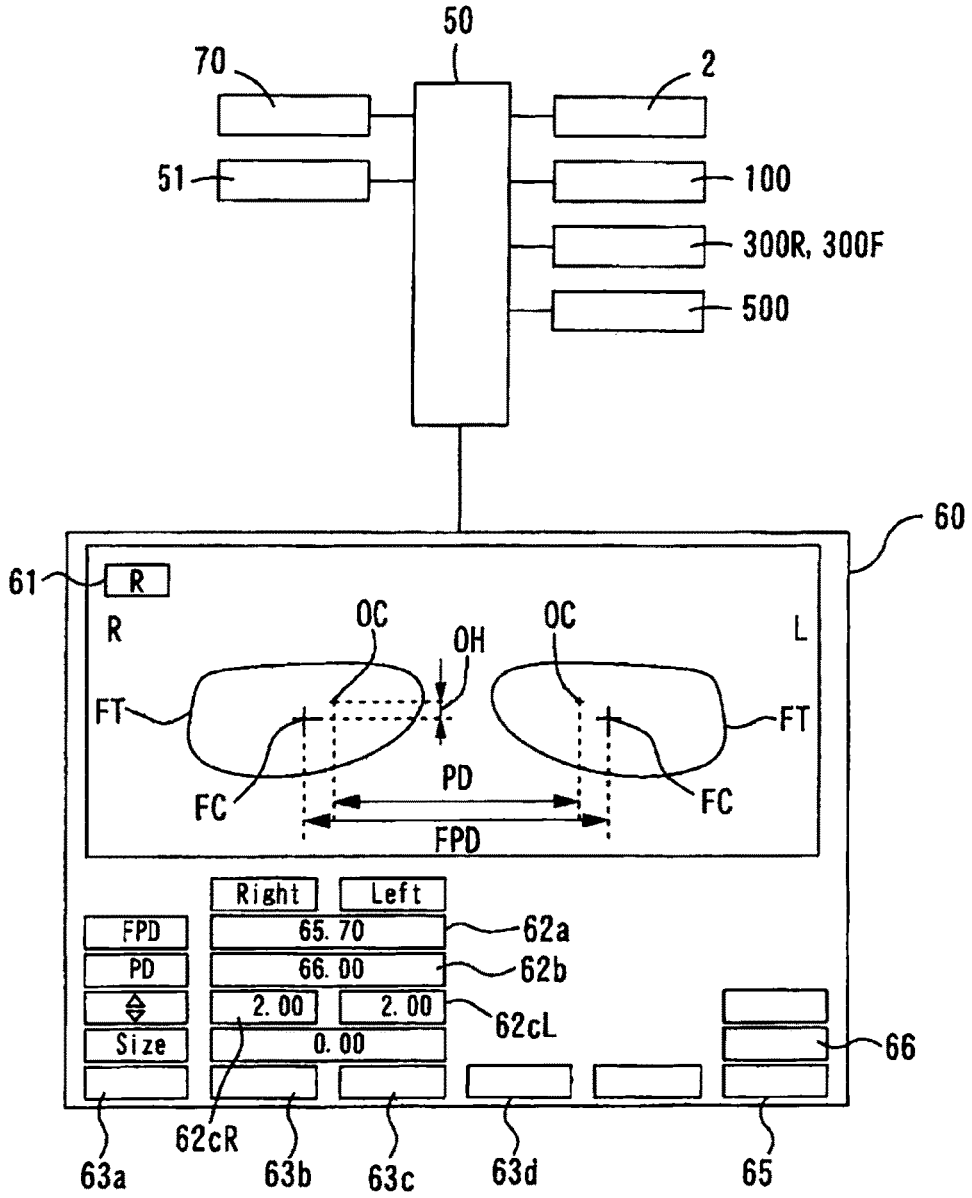
FIG. 5 is a control block diagram of the eyeglass lens processing apparatus.

FIG. 5 is a control block diagram of the eyeglass lens processing apparatus. The control unit 50 performs the integrated control of the entire apparatus, and performs the calculation processing based on each measurement data and input data. Each motor of the apparatus 1, the lens edge position detection units 300F and 300R, and the lens outer diameter detection unit 500 are connected to the control unit 50. Furthermore, a display 60 having a touch panel function for data input of the processing condition, a switch portion 70 having various switches, a memory 51, an eyeglass frame shape measuring device 2 or the like are connected to the control unit 50. The switch portion 70 is provided with a switch which starts the processing of the lens LE.

The target lens shape data of the lens frame (a rim) of the eyeglass frame obtained by the measurement of the eyeglass frame shape measuring device 2 is input to the processing apparatus 1 by the operation of the switch of the switch portion 70, and is stored in the memory 51. Each target lens shape data of a right lens frame and a left lens frame is input or one target lens shape data of the left and the right is input from the eyeglass frame shape measuring device 2. In a case where one target lens shape data of the left and the right is input, the control unit 50 obtains the other target lens shape data by inverting the left and the right of the input target lens shape data.

FIG. 5 shows an example of the setting screen which is displayed on the display 60 so as to set the processing condition. On the left upper side of the screen, a switch 61 is displayed which selects (sets) which one is the left or the right of the processing target lens. Whenever the switch 61 is touched, "R" and "L" of the display of the switch 61 is switched, and it is selected which one is the left side or the right side (left lens or right lens) of the lens.

Furthermore, a target lens shape figure FT is displayed on the display 60, based on the target lens shape data called from the memory 51. By operating the respective switches (keys) of the display 60, the layout data of the optical center OC of the left lens with respect to the geometric center FC of the left target lens shape is input, and the layout data of the optical center OC of the right lens with respect to the geometric center FC of the right target lens shape is input. A geometric center distance (a FPD value) of the left and right lens frames is input to an input box 62*a*. A pupil-to-pupil distance (a PD value) of a wearer is input to an input box 62*b*. A height of the right optical center OC with respect to the geometric center FC of the right target lens shape is input to an input box 62*c*R. A height of the left optical center OC with respect to the geometric center FC of the left target lens shape is input to an input box 62*c*L. The numerical values of each input box can be input by a numeric keypad which is displayed by touching the input boxes.

Furthermore, it is possible to set the processing conditions such as a material of the lens, a type of the frame, working modes (a bevel processing mode, and a flat processing mode), and presence or absence of the chamfering processing by the switches 63*a*, 63*b*, 63*c*, and 63*d*.

Furthermore, prior to the processing of the lens LE, an operator fixes a cup Cu, which is a fixing jig, to the lens refractive surface of the lens LE by the use of a known axis stoker. At this time, there are an optical center mode which fixes the cup to the optical center OC of the lens LE, and a frame center mode which fixes the cup to the geometric center FC of the target lens shape. It is possible to select that the chuck center (the processing center) of the lens chuck shafts 102L and 102R is which one of the optical center mode and the frame center mode by the right lower switch 65 of the screen of the display 60. Furthermore, on the screen, a switch 66 is provided which sets "retouching" that is the size adjusting processing for reducing the outer diameter of the processed lens.

Next, a basic processing operation of the lens periphery processing will be described. After the lens LE is held in the lens chuck shafts 102L and 102R, when the start switch of the switch portion 70 is pressed, the lens outer diameter detection unit 500 is operated by the control unit 50, and the outer diameter of the lens LE is detected around the lens chuck shaft. By obtaining the outer diameter of the lens LE, it is confirmed whether or not the outer diameter of the lens LE is insufficient for the target lens shape. In a case where the outer diameter of the lens LE is insufficient, the warning is displayed on the display 60.

When the outer diameter detection of the lens LE is finished, next, the lens edge position detection units 300F and 300R are driven by the control unit 50, and the shapes of the front refractive surface and the rear refractive surface of the lens LE in the edge position of the target lens shape are detected. The lens thickness in the edge position of the target lens shape is obtained from the shapes of the detected front refractive surface and rear refractive surface. In a case where the bevel processing mode is set, the bevel trace, which is the trace of the placement of the bevel apex, is obtained by a predetermined calculation based on the edge position detection information of the front refractive surface and the rear refractive surface of the lens.

When the edge position detection of the lens LE is finished, the roughing trace is calculated based on the input target lens shape, and the periphery of the lens LE is processed along the roughing trace by the coarse grindstone 162. The roughing trace is calculated by adding the finishing allowance to the target lens shape. The control unit 50 obtains the roughing control data of the rotation angles of the lens chuck shafts 102L and 102R and the movement of the lens chuck shafts 102L and 102R in the Y axis direction, based on the roughing trace, and roughs the periphery of the lens LE by the coarse grindstone 162. Next, the control unit 50 obtains the finishing control data of the rotation angles of the lens chuck shafts 102L and 102R and the movement of the lens chuck shafts 102L and 102R in the Y axis direction, based on the finishing trace (the bevel trace), and finishes the periphery of the lens LE by the finishing grindstone 164.

Next, the left and right confirmation operation will be described which confirms that there is no mistake in the left and right of the lens LE held in the lens chuck shafts 102L and 102R with respect to the left and right selections of the lens set by the switch 61. The left and right confirmation includes a method of using the detection result of the lens outer diameter detection unit 500, and a method of using the detection result of the lens edge position detection units 300F and 300R.

Firstly, a case will be described where the detection result of the lens outer diameter detection unit 500 is used, the lens LE is a blank lens, and the frame center mode (a mode in which the geometric center FC of the target lens shape is the chuck center) is set.

As mentioned above, the lens outer diameter detection unit 500 is operated by the signal input of the start switch, and the outer diameter of the lens LE centered on the lens chuck shaft is detected. The control unit 50 confirms that there is no mistake in the left and right of the lens LE held in the lens chuck shafts 102L and 102R (the lens LE is the left lens or the right lens), based on the detection result of the lens outer diameter detection unit 500, the layout data (position relationship data between the chuck center and the optical center OC of the lens LE) which is input by the display 60, and the left and right selection data of the lens LE which is set by the switch 61.

Figure 6:
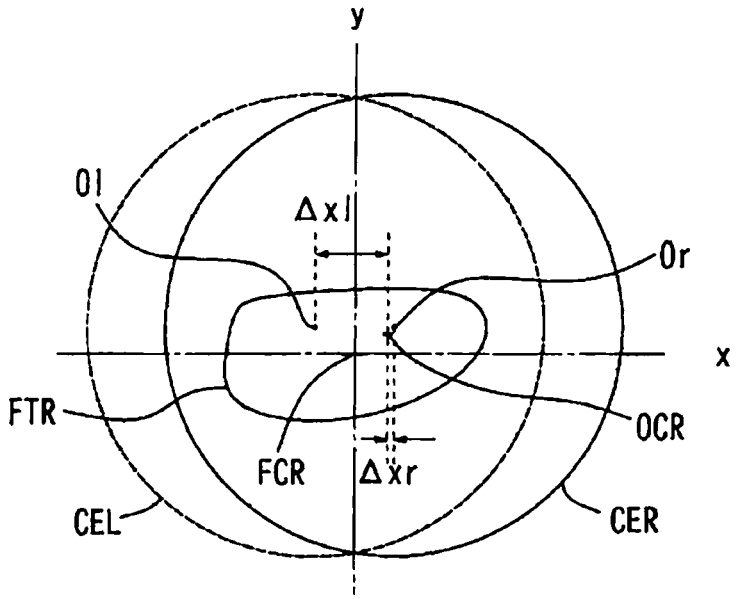
FIG. 6 is an explanatory diagram of the left and right confirmation which uses the detection result of the lens outer diameter.

FIG. 6 is an explanatory diagram of the left and right confirmation which uses the detection result of the lens outer diameter, and is a case where the right lens is selected by the switch 61 and the target lens shape for the right lens is called from the memory 51. In FIG. 6, the target lens shape FTR is set for the right lens by the selection of the right lens, and the FCR is the geometric center of the target lens shape FTR. The geometric center FCR is the chuck center of the lens chuck shaft in the frame center mode. In FIG. 6, the OCR shows the optical center position of the lens LE determined by the input of the layout data for the right lens. The circle CER is an example of the lens outer diameter trace detected by the lens outer diameter detection unit 500 when the right lens is correctly held in the lens chuck shaft. Or shows the geometric center of the circle CER, and in the case of the blank lens, Or is calculated to the optical center position of the right lens LE.

The control unit 50 compares the optical center position OCR due to the layout data to the optical center position Or, and obtains the amount of deviation. For the left and right confirmation, in regard to the horizontal position (the x direction of FIG. 6), the eccentricity $\Delta xr$ may be obtained. If the eccentricity $\Delta xr$ does not exceed a predetermined allowable value S (for example, 1 mm) and the position OCR substantially coincides with the position Or, it is confirmed (determined) that the lens LE held in the lens chuck shaft is the right lens as set by the switch 61. If there is no mistake in the left and right confirmation of the lens LE, the processing of the lens periphery through the coarse grindstone 162 and the finishing grindstone 164 is performed. In order to notify the confirmation result of the left and right sides of the lens LE to an operator, a configuration may be adopted in which the confirmation result is displayed on the display 60.

Meanwhile, in FIG. 6, the circle CEL is an example of the lens outer diameter trace detected by the lens outer diameter detection unit 500 when the left lens is incorrectly held in the lens chuck shaft. Ol indicates the geometric center of the circle CER and is calculated to be the optical center position of the left lens. The control unit 50 compares the optical center position OCR due to the layout data to the optical center position Ol, and obtains the amount of deviation Δxl of the horizontal direction. When the eccentricity Δxl exceeds a predetermined allowable value S, the lens LE held in the lens chuck shaft is the left lens, and it is confirmed (determined) that the setting of the right lens through the switch 61 is wrong. Moreover, the warning that the left and right sides of the lens LE are wrong is displayed on the display 60, and the mistake of the left and right sides of the lens LE is notified to an operator. Furthermore, the processing operation of the lens periphery after that is stopped. The display 60 is used as the warning device which warns the mistake of the left and right sides of the lens. As the warning device, besides the display 60, a buzzer generating the warning sound may be provided.

An operator can notice that the left and right sides of the lens held in the lens chuck shaft are wrong, by the warning of the display 60 or the stop of the processing operation of the device, and can correct the error. As a result, it is possible to prevent the periphery being processed in the state where the left and right sides are wrong, whereby it is possible to suppress the occurrence of the lens being unusable.

In addition, the above situation is a case where the right lens is selected by the switch 61, but in a case where the left lens is selected, by simply reversing the left and right sides, the left and right confirmation is basically performed by the same method.

In the above situation, the optical center position Or (Ol) of the lens LE is obtained by the use of the detection result of the lens outer diameter, and it is also possible to use the lens edge position detection units 300F and 300R (the lens refractive surface shape measurement unit). Hereinafter, a method of using the lens edge position detection units 300F and 300R will be described.

Figure 7:
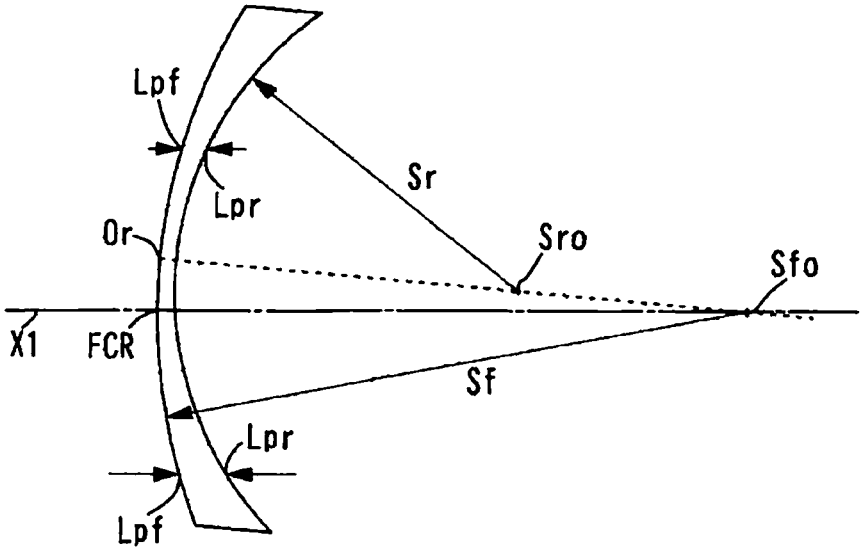
FIG. 7 is an explanatory diagram of a case of obtaining an optical center from a lens refraction surface shape.

FIG. 7 is an explanatory diagram of a case of obtaining the optical center from the refractive surface shape of the lens. The control unit 50 obtains the curve spherical surface of the lens refractive surface and the center position Sfo of the curve spherical surface by a predetermined calculation, based on the detection result of the target lens shape lens front refractive surface edge position Lpf through the control unit 300F. For example, by selecting arbitrary four points from the lens front refractive surface edge position Lpf of the lens whole periphery and obtaining the radius Sf of the spherical surface when the four points are situated on the spherical surface, the center position Sfo of the spherical surface can be obtained. As another method, the position can be obtained as below. The slope angle of the straight line Lf (not shown) passing through the two points of the target lens shape lens front refractive surface edge position Lpf and the lens front refractive edge position outside from that by a predetermined amount for each minute vectorial angle of the target lens shape is obtained, and based on the slope angle of the straight line Lf in the plurality of edge positions Lpf of the lens entire periphery, the radius Sf of the spherical surface of the lens front refractive surface and the center position Sfo can be optically obtained.

The radius Sf of the spherical surface of the lens rear refractive surface and the center position Sro thereof can also be obtained by the same calculation based on the detection result of the lens rear refractive surface edge position Lpr. When the lens LE is an astigmatic lens, the lens rear refractive surface is a toric surface, but the center position Sro is obtained by obtaining the toric surface as an averaged spherical surface. Moreover, the straight line connecting the center position Sfo with the center position Sro is obtained, and the point, on which the straight line intersects with the curve spherical surface of the lens rear refractive surface, can be approximately calculated as the optical center Or. The optical center Or is obtained as the position data with respect to the chuck center FCR of the lens chuck shaft. In FIG. 7, the center FCR is situated on the axis X1 of the lens chuck shaft.

If the position data of the optical center Or with respect to the chuck center FCR is obtained, like a case of FIG. 6 which uses the lens outer diameter detection, the left and right sides of the lens LE held in the lens chuck shafts 102L and 102R are confirmed, based on the layout data which is input by the switch 60, and the left and right selection data of the lens LE which is set by the switch 61.

In addition, in the confirmation of the left and right sides of the blank lens, when using both of the detection result by the lens outer diameter detection unit 500 described in FIG. 6 and the detection result by the lens edge position detection units 300F and 300R, the reliability of the confirmation result is improved.

Next, the left and right confirmation of the case of performing the retouching for adjusting the size of the processed lens will be described.

As mentioned above, after the bevel processing of both of left and right lenses is finished as mentioned above, when the switch 66 on the screen of the display 60 is pressed, the processing mode of the eyeglass lens processing device is shifted to the retouching mode. The screen of FIG. 5 is switched to the retouching screen for inputting processing condition data required for the retouching such as the size adjusting data (not shown). Furthermore, on the retouching screen, like the screen of FIG. 5, the switch 61 for selecting the left and right sides of the lens LE attached to the lens chuck shaft is provided.

In the retouching mode, the left and right confirmation of the lens LE also includes a method of using the lens outer diameter detection unit 500 and a method of using the lens edge position detection units 300F and 300R. Firstly, the method of using the lens outer diameter detection unit 500 will be described.

Figure 8:
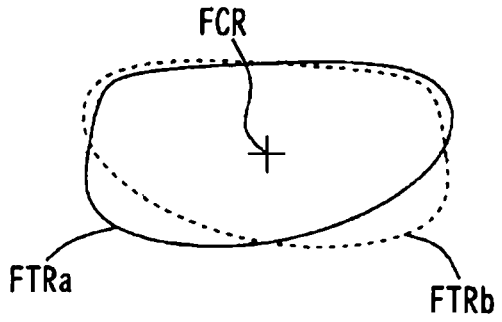
FIG. 8 is an explanatory diagram of an outer diameter trace of the processed lens which is detected by the lens outer diameter detection unit.

After the lens LE is held in the lens chuck shafts 102L and 102R, when the start switch of the switch 7 is pressed, the lens outer diameter detection unit 500 is operated by the control unit 50. The right lens of the lenses LE is selected by the selection switch 61. FIG. 8 is an explanatory diagram of the outer diameter trace of the processed lens which is detected by the lens outer diameter detection unit 500. In FIG. 8, the outer diameter trace FTRa is a trace of a case where the processed lens is the right lens as selected by the selection switch 61. The control unit 50 compares the trace FTRa obtained by the lens outer diameter detection unit 500 to the right target lens shape data used in the periphery processing before the retouching, and confirms whether or not both of them substantially coincide with each other. The right target lens shape data is stored and held in the memory 51 and is called by the selection of the right lens through the selection switch 61. When the called right target lens shape data substantially coincides with the trace FTRa, the control unit 50 determines that there is no mistake in the left and right sides of the processed lens attached to the lens chuck shaft, moves the lens chuck shafts 102R and 102R to the XY direction based on the size adjustment data which is input by the retouching screen and the right target lens shape data, and performs the finishing processing by the finishing grindstone 164.

Meanwhile, when the processed left lens is erroneously attached to the lens chuck shafts 102R and 102L, the trace FTRb in FIG. 8 is a trace detected by the lens outer diameter detection unit 500. The control portion 70 compares the trace FTRb with the right target lens shape data. When both of them do not substantially coincide with each other, the control portion 70 determines that the left and right sides of the processed lens attached to the lens chuck shaft are wrong, and displays the warning on the screen of the display 60. Furthermore, the control unit 50 stops the processing operation. As a result, a worker is notified that the left and right sides of the lens are wrong.

In addition, the method of comparing the trace FTRa (FTRb) to the right target lens shape (the left target lens shape) determined by the left and right selection information can be also applied to the "optical center mode" which holds the optical center of the lens LE.

Figure 9:
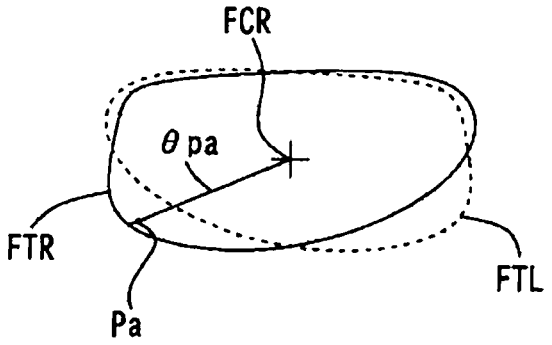
FIG. 9 is an explanatory diagram of a method of using the lens edge position detection unit in the retouching mode.

Next, a method of using the lens edge position detection units 300F and 300R in the retouching mode will be described. As shown in FIG. 9, the control unit 50 calls the data of the right target lens shape FTR and the left target lens shape FTL stored in the memory 51, and compares both of them. The control unit 50 extracts the different points of the target lens shape radius between the right target lens shape FTR and the left target lens shape FTL, and determines the position of the lens refractive surface with which the tracing stylus 306F (or 306R) of the lens edge position detection unit 300F (or 300R) comes into contact, based on the left and right selection information.

For example, when the right lens is selected, the control unit 50 obtains the vectorial angle θpa in which the target lens shape radius of the right target lens shape FTR is greatly different from the left target lens shape FTL, and defines the point Pa somewhat inside (for example, 0.5 mm) from the edge position of the vectorial angle θpa of the right target lens shape FTR as the contact position. Moreover, the lens edge position detection unit 300F is operated, and the tracing stylus 306F is brought into contact with the lens refractive surface based on the vectorial angle θpa of the point Pa and the vectorial length (the radius). If the right lens is correctly attached to the lens chuck shafts 102L and 102R, the tracing stylus 306F comes into contact with the lens refractive surface, and thus the contact is detected from the output signal of the encoder 313F.

When the left lens is attached to the lens chuck shafts 102L and 102R, the tracing stylus 306F does not come into contact with the lens refractive surface, and it is detected that there is no lens. Whether or not the tracing stylus 306F comes into contact with the lens refractive surface is obtained from the detection of the encoder 313F. The detection data of the edge position of the right lens and the left lens before the retouching is stored in the memory 51. If the detected edge position greatly deviates from the edge position data of the vectorial angle θpa of the right lens stored in the memory 51, the lens LE held in the lens chuck shaft is confirmed (determined) as the left lens.

Figure 10:
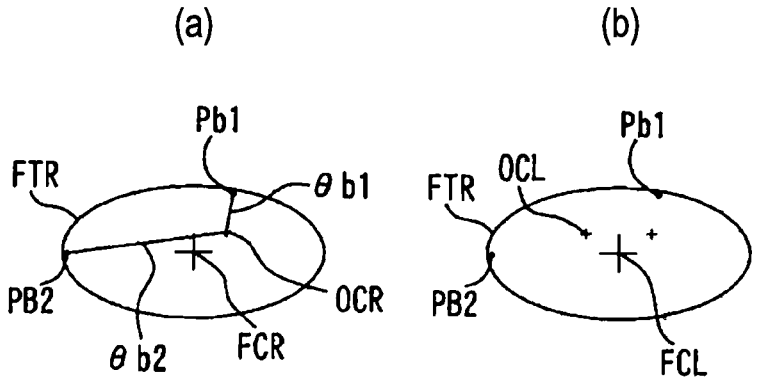
FIG. 10 is an explanatory diagram of another method of using the lens edge position detection unit in the retouching mode.

Another method of using the lens edge position detection units 300F and 300R in the retouching mode will be described. As shown in FIG. 10, when the target lens shape is the frame center mode in the left and right symmetrical shape, the determination accuracy is worse in the method of using the lens outer diameter detection unit 500, and thus the method mentioned below is effective. This method is a method of confirming the left and right sides of the lens even in the left and right symmetrical target lens shape, based on the fact that the thickness of the edge position is different between the left lens and the right lens.

The control unit 50 calls the edge position data of the selected lens from the memory 51 based on the left and right selection information, and obtains the edge thickness of the whole periphery of the target lens shape. Based on the edge thickness data, the position is determined with which the respective tracing styluses 306F and 306R of the lens edge position detection units 300F and 300R are brought into contact. As the position with which the tracing styluses 306F and 306R are brought into contact, if the position is a point in which the edge positions are different between the left lens and the right lens, one point may be satisfactory. However, a point is preferable in which the difference in the lens between the left lens and the right lens thickness easily appears. FIG. 10(*a*) is a case where the right lens is selected. As a point in which the difference in the lens thickness between the left lens and the right lens easily appears, any one (or both) of a point Pb1 of the vectorial angle θb1 in which the radius from the optical center OCR is the minimum and a point Pb2 of the vectorial angle θb2, in which the radius from the optical center OCR is the maximum, is used. The optical center OCR is the position defined by the layout data and substantially coincides with the actual optical center of the lens. The point Pb1 and the point Pb2 is defined as a point somewhat inside (for example, 0.5 mm) from the edge position. For example, the control unit 50 brings the tracing styluses 306F and 306R into contact with the lens front refractive surface and the lens rear refractive surface of the point Pb1, and obtains the respective positions. The lens thickness of the point Pb1 is obtained from the respective edge positions. Moreover, the control unit 50 calls the edge positions of the lens front refractive surface and the lens rear refractive surface obtained at the time of measuring the blank lens before the retouching from the memory 51, compares the edge position to the edge thickness (the edge thickness of the point Pb1) in the retouching mode, and if both of them substantially coincide with each other, the lens LE is determined as right lens.

Meanwhile, when the lens LE held in the lens shuck shaft is the left lens, as shown in FIG. 10 (*b*), since the distance from the optical center OCL of the left lens to the point Pb1 is different from the right lens, the edge thickness also differs. Thus, when the difference in the edge thickness exceeds a predetermined allowance amount in the comparison, the lens LE held in the lens chuck shaft is determined as the left lens and is warned by the display 60. Even when the point Pb2 is used, the same determination is performed. If both of the point Pb1 and the point Pb2 is used, an accuracy of determination of the left and right lenses is improved.

In the left and right confirmation mentioned above, any one of the lens outer diameter detection unit 500 and the lens edge position detection units 300F and 300R may be used, but when using a combination of both, the accuracy of the left and right confirmation is further improved.

What is claimed is:

1. An eyeglass lens periphery processing apparatus for processing a periphery of an eyeglass lens by a periphery processing tool, the apparatus comprising:

a lens chuck shaft configured to hold the eyeglass lens;

a data input unit configured to input target lens shape data and layout data of an optical center of the lens with respect to the target lens shape of at least one of a left lens and a right lens;

a left and right lens selecting unit configured to input a selection signal as to whether the lens held by the lens chuck shaft is the right lens or the left lens;

a lens shape detecting unit configured to detect one of a shape of the refractive surface of the lens held by the lens chuck shaft and an outer diameter of the lens held by the lens chuck shaft;

a determining unit configured to determine whether the lens held by the lens chuck shaft is the correct one of the right lens and the left lens based on the detecting result of the lens shape detecting unit, the layout data for both the left lens and the right lens, and the input selection signal; and a notifying unit configured to notify the result of the determining unit.

2. The eyeglass lens periphery processing apparatus according to claim 1 further comprising:

a retouching mode setting unit configured to set a retouching mode for adjusting a size of the processed lens; and a memory for storing a right target lens shape and a left target lens shape, wherein the lens shape detecting unit includes a lens refractive surface shape detecting unit configured to detect a shape of a front refractive surface and a rear refractive surface of the lens held by the lens chuck shaft, and wherein when the retouching mode setting unit sets the retouching mode, the determining unit obtains different points between the right target lens shape and the left target lens shape, and causes the lens refractive surface shape detecting unit to detect a part of the refractive surface of the surface held by the lens chuck shaft based on the obtained different points, and determines whether the lens held by the lens chuck shaft is the correct one of the right lens and the left lens based on the detecting result of the lens refractive surface shape detecting unit.

3. The eyeglass lens periphery processing apparatus according to claim 1 further comprising:

a retouching mode setting unit configured to set a retouching mode for adjusting a size of the processed lens, wherein the lens shape detecting unit includes a lens refractive surface shape detecting unit configured to detect a shape of a front refractive surface and a rear refractive surface of the lens held by the lens chuck shaft, and wherein the eyeglass lens periphery processing apparatus includes a memory for storing an edge thickness of the left lens and an edge thickness of the right lens detected by the lens refractive surface shape detecting unit based on the target lens shape before retouching, wherein when the retouching mode setting unit sets the retouching mode, the determining unit obtains different points of the edge thicknesses stored in the memory between the left lens and the right lens, causes the lens refractive surface shape detecting unit to detect a first edge thickness of the lens held by the lens chuck shaft, and determines whether the lens held by the lens chuck shaft is the correct one of the right lens and the left lens based on the detected first edge thickness and a second edge thickness which is the edge thickness of the left lens or the right lens read out from the memory based on the selection signal.

4. The eyeglass lens periphery processing apparatus according to claim 1 further comprising a retouching mode setting unit configured to set a retouching mode for adjusting a size of the processed lens, wherein the lens shape detecting unit includes a lens outer diameter detecting unit configured to detect the outer diameter of the lens held by the lens chuck shaft wherein when the retouching mode setting unit sets the retouching mode, the determining unit compares the lens outer diameter shape detected by the lens outer diameter detecting unit with a left or right target lens shape which is determined by the selection unit, and determines whether the lens held by the lens chuck shaft is the correct one of the right lens and the left lens based on the comparison result.

5. The eyeglass lens periphery processing apparatus according to claim 1, wherein:

the determining unit is configured such that when the target lens shape data is input for one of the left or the right lens, the determining unit obtains the target lens shape data for the other of the left of the right lens by inverting the target lens shape data that has been input for the one of the left or the right lens.

6. An eyeglass lens periphery processing apparatus for processing a periphery of an eyeglass lens by a periphery processing tool, the apparatus comprising:

a lens chuck shaft configured to hold the eyeglass lens;

a data input unit configured to input target lens shape data and layout data of an optical center of the lens with respect to the target lens shape;

a left and right lens selecting unit configured to input a selection signal as to whether the lens held by the lens chuck shaft is a right lens or a left lens;

a lens shape detecting unit configured to detect one of a shape of the refractive surface of the lens held by the lens chuck shaft and an outer diameter of the lens held by the lens chuck shaft;

a determining unit configured to:

obtain a first optical center position of the lens held by the lens chuck shaft based on the detecting result of the lens shape detecting unit;

obtain a second optical lens position of the lens based on the layout data and the input selection signal;

compare the first optical center position with the second optical center position; and determine whether the lens held by the lens chuck shaft is the correct one of the right lens and the left lens based on the comparison result; and a notifying unit configured to notify the result of the determining unit.

7. The eyeglass lens periphery processing apparatus according to claim 6, wherein the lens shape detecting unit includes a lens refractive surface shape detecting unit configured to detect a shape of a front refractive surface and a rear refractive surface of the lens held by the lens chuck shaft, and the determining unit obtains a center position of the front refractive surface and a center position of the rear refractive surface based on the shape of the front refractive surface and the shape of the rear refractive surface which are detected by the lens refractive surface shape detecting unit, and obtains the first optical center position based on the obtained center position of the front refractive surface and the obtained center position of the rear refractive surface.

8. The eyeglass lens periphery processing apparatus according to claim 6, wherein the lens shape detecting unit includes a lens outer diameter detecting unit configured to detect the outer diameter of the lens held by the lens chuck shaft, and the determining unit obtains a geometry center of the outer diameter shape of the lens based on the detecting result of the lens outer diameter detecting unit, and obtains the first optical center position based on the obtained geometry center.

9. An eyeglass lens periphery processing apparatus for processing a periphery of an eyeglass lens by a periphery processing tool, the apparatus comprising:

a lens chuck shaft configured to hold the eyeglass lens;

a left and right lens selector configured to input a selection signal as to whether the lens held by the lens chuck shaft is a right lens or a left lens;

a detector configured to detect one of a shape of a refractive surface of the lens held by the lens chuck shaft and an outer diameter of the lens held by the lens chuck shaft; and a determination unit configured to obtain a position of an optical center of the lens held by the lens chuck shaft based on the detection result by the detector, obtain eccentricity information based on the obtained position of the optical center, and determine whether the lens held by the lens chuck shaft is the correct one of the right lens and the left lens based on the eccentricity information.

10. An eyeglass lens periphery processing apparatus for processing a periphery of an eyeglass lens by a periphery processing tool, the apparatus comprising:

a lens chuck shaft configured to hold the eyeglass lens;

a left and right lens selecting unit configured to input a selection signal as to whether the lens held by the lens chuck shaft is a right lens or a left lens;

a detector configured to detect one of a shape of the refractive surface of the lens held by the lens chuck shaft and an outer diameter of the lens held by the lens chuck shaft;

a retouching mode setting unit configured to set a retouching mode for adjusting a size of the processed lens; and a determining unit configured to determine whether the lens held by the lens chuck shaft is the correct one of the right lens and the left lens based on the detecting result of the detector and the input selection signal.

11. The eyeglass lens periphery processing apparatus according to claim 10, wherein the detector includes a lens outer diameter detecting unit configured to detect the shape of the outer diameter of the lens held by the lens chuck shaft, and the determining unit compares the shape of the outer diameter of the lens detected by the lens outer diameter detecting unit with a target lens shape for the left lens or the right lens determined based on the input selection signal, and determines whether the lens held by the lens chuck shaft is the correct one of the right lens and the left lens based on the comparison result.

12. The eyeglass lens periphery processing apparatus according to claim 10 further comprising:

a memory for storing a right target lens shape and a left target lens shape, the detector includes a lens refractive surface shape detecting unit configured to detect the shape of the refractive surface of the lens held by the lens chuck shaft, and wherein when the retouching mode setting unit sets the retouching mode, the determining unit obtains different points between the right target lens shape and the left target lens shape, causes the lens refractive surface shape detecting unit to detect a part of the refractive surface of the lens held by the lens chuck shaft based on the obtained different points, and determines whether the lens held by the lens chuck shaft is the correct one of the right lens and the left lens based on the detecting result of the lens refractive surface shape detecting unit.

13. The eyeglass lens periphery processing apparatus according to claim 10 further comprising:

a memory for storing an edge thickness of the left lens and an edge thickness of the right lens based on the target lens shape before retouching, wherein the detector includes a lens refractive surface shape detecting unit configured to detect a shape of a front refractive surface and a rear refractive surface of the lens held by the lens chuck shaft, and wherein when the retouching mode setting unit sets the retouching mode, the determining unit obtains different points of the edge thicknesses stored in the memory between the left lens and the right lens, causes the lens refractive surface shape detecting unit to detect a first edge thickness of the lens held by the lens chuck shaft, and determines whether the lens held by the lens chuck shaft is the correct one of the right lens and the left lens based on the detected first edge thickness and a second edge thickness which is the edge thickness of the left lens or the right lens read out from the memory based on the selection signal.

* * * * *